US006126131A

United States Patent [19]

Tietz

[11] Patent Number: 6,126,131

[45] Date of Patent: Oct. 3, 2000

[54] PALLET FOR CHESTS AND BOXES WITH CASTERS

[76] Inventor: Wayne D. Tietz, 1417 Hwy. 18 E., Algona, Iowa 50511

[21] Appl. No.: 09/177,227

[22] Filed: Oct. 22, 1998

[51] Int. Cl.[7] ..... A47B 91/00

[52] U.S. Cl. ..... 248/346.01; 108/55.3; 206/503

[58] Field of Search ..... 248/346.01, 346.02, 248/346.11; 280/998; 206/821; 108/53.1, 53.5, 901, 51.11, 57.16, 57.17, 57.33, 55.3, 57.21, 55.1, 57.15, 57.29

[56] References Cited

U.S. PATENT DOCUMENTS

| | | | |
|---|---|---|---|
| 1,912,847 | 6/1933 | Klepel | 206/503 |
| 3,285,204 | 11/1966 | Schweitzer, Jr. | 108/55.3 |
| 3,630,157 | 12/1971 | Ortenblad | 108/53.3 |
| 4,738,425 | 4/1988 | Foster | 248/346.01 |
| 5,046,587 | 9/1991 | Jones | 188/32 |
| 5,785,328 | 7/1998 | Eckloff | 280/33.998 |
| 5,787,817 | 8/1998 | Heil | 108/57.21 |

*Primary Examiner*—Anita M. King
*Attorney, Agent, or Firm*—Zarley, McKee, Thomte, Voorhees & Sease

[57] ABSTRACT

A pallet is provided for receiving a tool chest or storage box mounted on casters. The pallet has a frame with four corners. Caster blocks are secured to the frame adjacent to each corner. Each caster block has a curved surface for receiving the casters of the tool chest or storage box to prevent the chest or box from moving on the pallet. The pallet with the chest or box safely positioned thereon can be moved with a forklift for transportation of the tool chest or storage box.

12 Claims, 4 Drawing Sheets

PALLET FOR CHESTS AND BOXES WITH CASTERS

BACKGROUND OF THE INVENTION

Large tool chest and other objects such as carts and storage boxes are often shipped on pallets. A flat-bottomed chest or cart sits upon the pallet for transportation thereon. If the tool chest or box has legs, pallets have been made with retainer blocks on each corner for receiving the legs, such that the chest or box will not move off of the pallet. Some chests and boxes are provided with casters for rolling the chest or box along the floor. Such castered chest and boxes have been shipped on pallets having additional perimeter side and/or end boards to prevent rolling of the chest or box on the pallet. However, such additional boards on the pallet increases the material and labor costs in constructing the pallet.

A primary objective of the present invention is the provision of a pallet for objects, such as tool chests and storage boxes, mounted on casters.

Another objective of the present invention is a provision of an improved pallet for castered objects which prevents movement of the object relative to the pallet.

Another objective of the present invention is the provision of a pallet for receiving casters which is economical to manufacture and durable and safe in use.

These and other objectives have become apparent from the following description.

SUMMARY OF THE INVENTION

A pallet is provided for supporting an object, such as a tool chest or storage box, mounted on casters. The pallet of the present invention includes a pair of opposite side rails and a pair of opposite end rails which are connected to form a rectangular frame having four corners. Four caster blocks are secured to the frame in each of the corners. Each caster block has a curved surface adapted to receive one of the casters of the object when the object is positioned on the pallet, thereby preventing movement of the object relative to the pallet. The curved upper surface of each caster block has a radius approximately equal to the radius of the caster. The curvature of the upper surface prevents the casters from rolling about their horizontal axle. A board may be provided on the pallet so as to extend between the caster blocks at each end of the pallet so as to prevent the casters from rotating about a vertical axis. The caster blocks may be constructed from wood, plastic or any other suitable material.

DETAILED DESCRIPTION OF THE INVENTION

Figure 1:
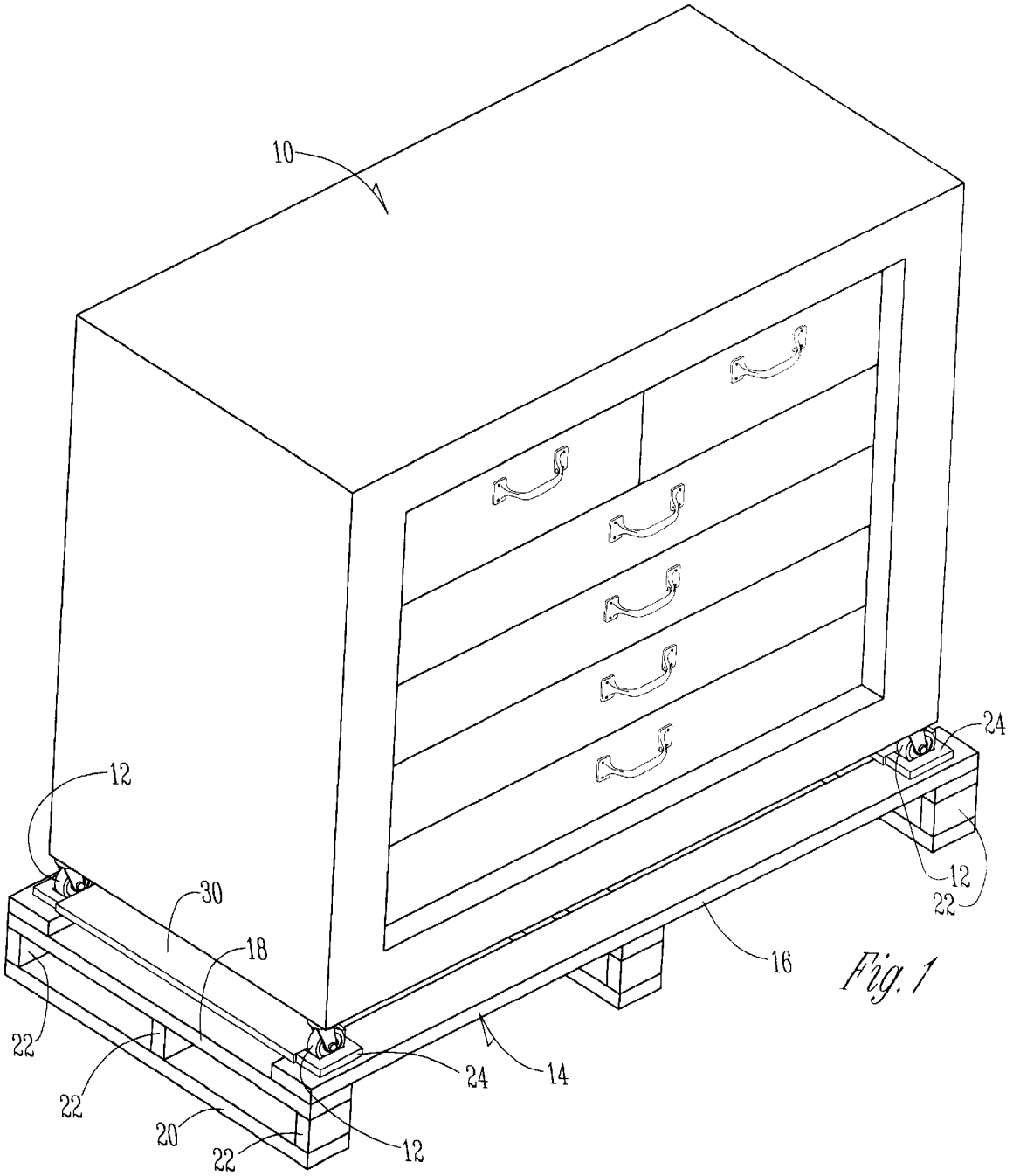
FIG. 1 is perspective view of tool chest supported by the pallet of the present invention.
Figure 2:
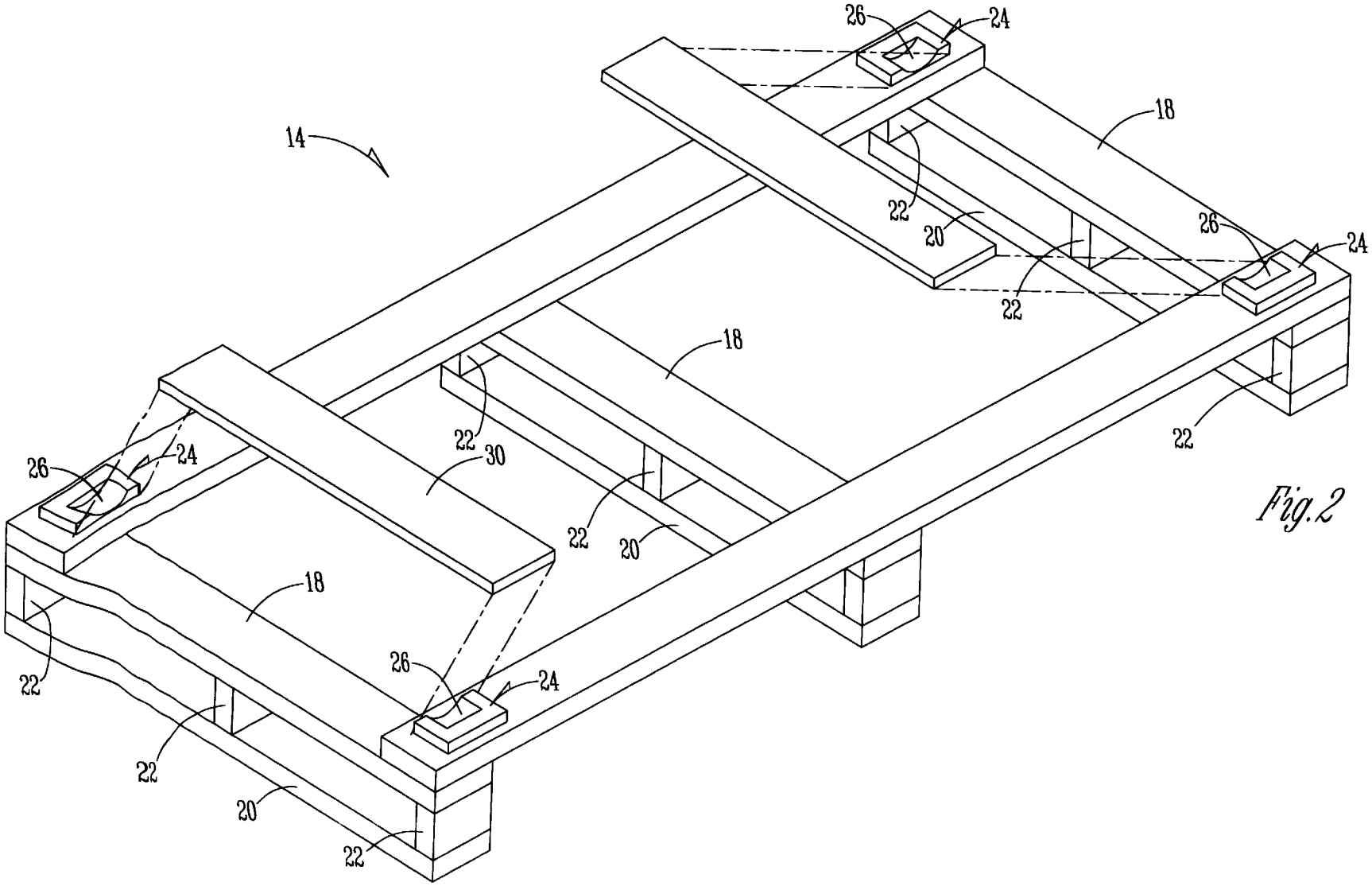
FIG. 2 is an exploded perspective view of the pallet.
Figure 3:
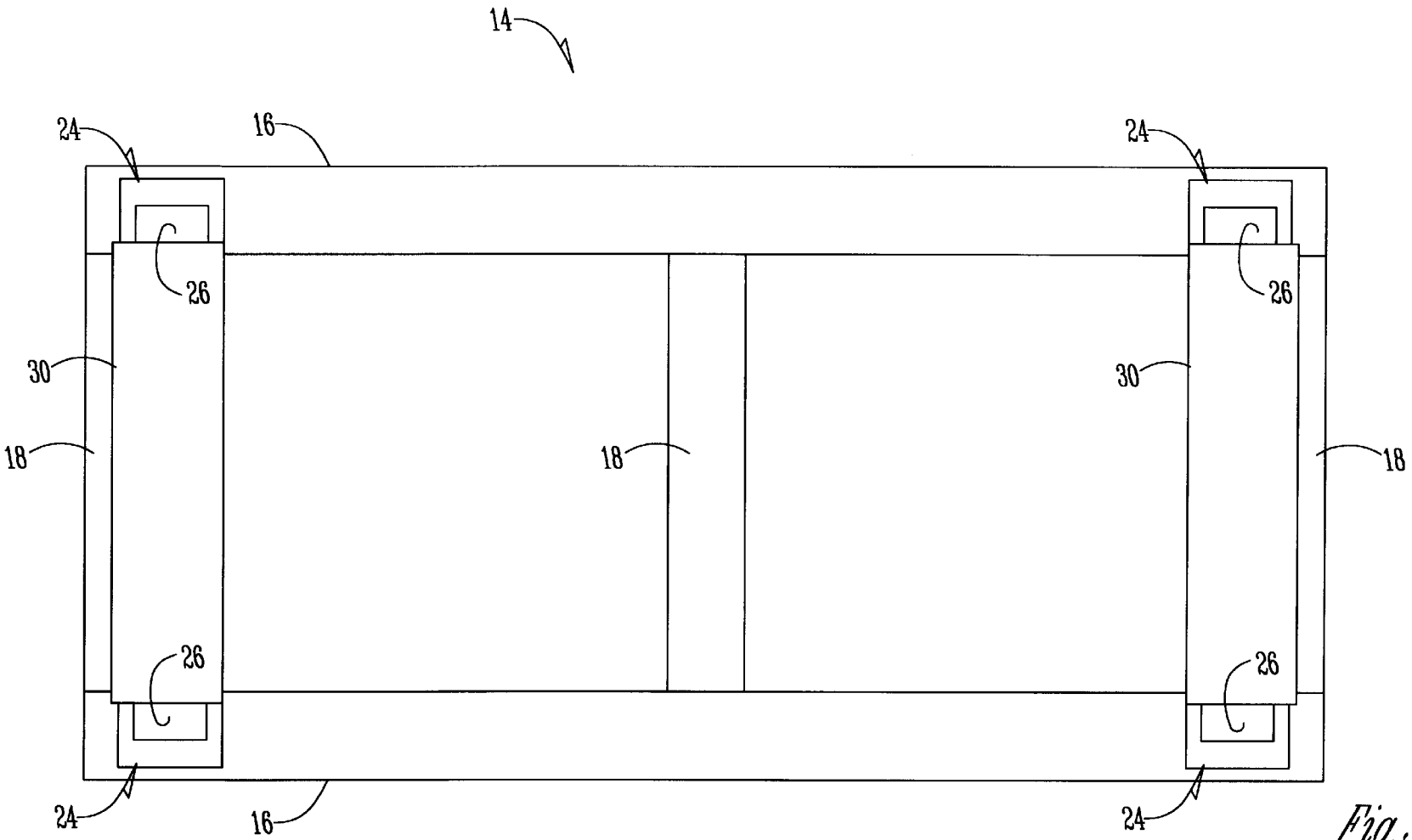
FIG. 3 is a top view of the pallet.
Figure 5:
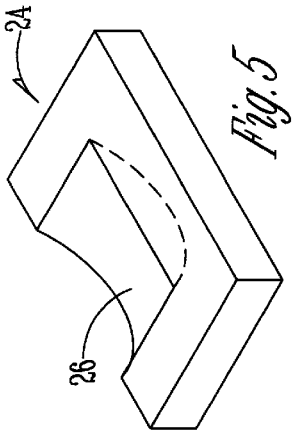
FIG. 5 is a perspective view of the caster block of the pallet of the present invention.
Figure 4:
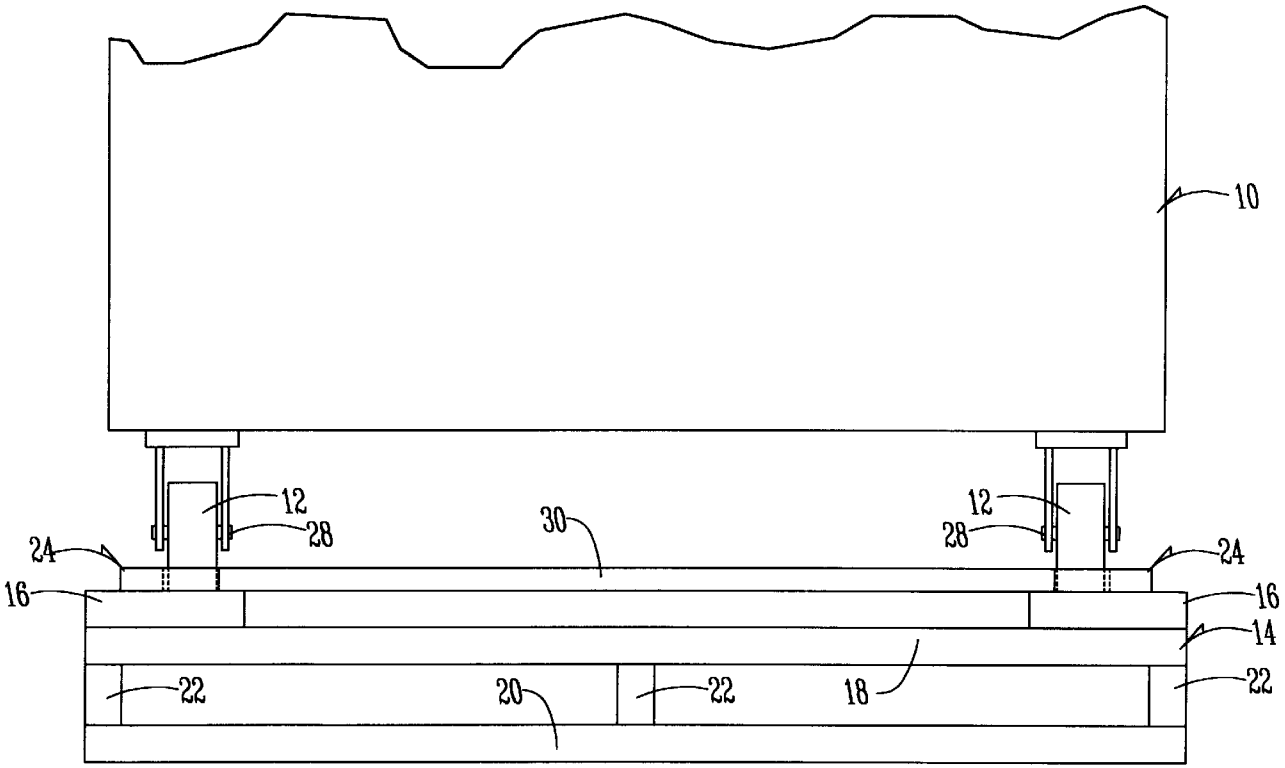
FIG. 4 is an end view of the pallet with the tool chest positioned thereon.

A tool chest or storage box is designated in the drawings by the reference 10. The tool chest is mounted upon casters 12 for rolling upon a floor. The tool chest 10 and casters 12 are conventional and do not constitute a part of the present invention.

The present invention is directed towards a pallet 14 for supporting the tool chest 10. The pallet includes opposite side rails 16. Upper and lower end boards 18, 20, respectively, located at each end of the pallet 14, are spaced apart by spacers or blocks 22. The side rails 16 and upper end boards 18 form a rectangular frame with four corners.

In the preferred embodiment, a caster block 24 is provided on each corner of the pallet 14. It is understood that less than four caster blocks 24 may be utilized, but at least one caster block 24 must be used for the casters 12 of the tool chest 10.

Each caster block 24 has a recess with a curved upper surface 26 adapted to receive one of the casters 12 of the tool chest 10. The radius of the curved surface 26 is approximately equal to the radius of the caster 12 such that the caster block 24 prevents rotation of the caster 12 about its horizontal axle 28.

If desired, an additional cross member 30 may be provided between caster blocks 24 at one or both ends of the pallet 14 so as to prevent the casters from rotating about a vertical axis. It is understood that the curved surface 26 may be formed within the perimeter of the block 24 such that the opposite sides of the recess are closed, thereby eliminating the need for the member 30.

The pallet 12 may be made from wood, plastic or any other durable material. The curved surface 26 of the caster blocks 24 may be milled or molded into the block.

With the pallet 14 of the present invention, the tool chest or storage box 10 can be set upon the pallet 14 with the casters 12 received in the caster blocks 24, such that the chest or box 10 will not move relative to the pallet 14. Thus, the pallet 14 can be lifted and moved using a conventional forklift for the transportation and shipping of the chest or box 10.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A pallet for objects mounted on casters, comprising:

a pair of side rails and a pair of end rails forming a rectangular frame having four corners; and four caster blocks secured to the frame adjacent each corner;

each caster block having a recess adapted to matingly receive one of the casters of the object when the object is positioned on the pallet and to prevent the caster from rotating and castering.

2. The pallet of claim 1 further comprising a board extending between two of the caster blocks adjacent one end of the pallet to prevent the casters from turning about a vertical axis.

3. The pallet of claim 1 wherein the recess includes a curved surface.

4. The pallet of claim 3 wherein the curved surface is semicircular.

5. The pallet of claim 3 wherein the curved surface has a radius about a horizontal axis.

6. The pallet of claim 1 wherein the caster blocks are wood.

7. The pallet of claim 1 wherein the caster blocks are plastic.

8. The pallet of claim 1 wherein the recess includes a curved surface and a raised edge on at least one side of the curved surface to preclude castering of the casters.

9. The pallet of claim 8 wherein the raised edge is adapted to engage a side of the caster to prevent castering.

10. A pallet for supporting an object on casters, comprising:

a frame having four corners;

at least one caster block on one of the corners of the frame;

a curved surface on the caster block adapted to matingly receive one of the casters of the object to prevent the object from rolling on the pallet; and a vertical surface adjacent the curved surface to prevent the casters from castering.

11. The pallet of claim 10 further comprising a member adjacent the caster block to prevent the caster from turning about a vertical axis.

12. The pallet of claim 10 wherein the caster block is constructed from wood or plastic.

* * * * *